US006172017B1

(12) United States Patent
Groemminger et al.

(10) Patent No.: US 6,172,017 B1
(45) **Date of Patent: *Jan. 9, 2001**

(54) CARBOHYDRATE COMPOSITION AND METHOD FOR CLEANING AND DISINFECTING CONTACT LENSES

(75) Inventors: Suzanne F. Groemminger; Rick Panicucci, both of Rochester, NY (US)

(73) Assignee: Bausch & Lomb Incorporated, Rochester, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/709,238

(22) Filed: Sep. 3, 1996

Related U.S. Application Data

(63) Continuation of application No. 08/471,672, filed on Jun. 6, 1995, now abandoned, which is a continuation of application No. 08/175,097, filed on Dec. 29, 1993, now abandoned.

(51) Int. Cl.[7] ..... C11D 17/00
(52) U.S. Cl. ..... 510/112; 510/470; 510/474
(58) Field of Search ..... 134/26, 42; 422/28; 424/78; 514/635; 510/112, 113, 470, 474

(56) References Cited

U.S. PATENT DOCUMENTS

| | | | | |
|---|---|---|---|---|
| Re. 32,672 | | 5/1988 | Huth et al. | 252/95 |
| 3,873,696 | * | 3/1975 | Randeri et al. | 424/162 |
| 4,259,202 | | 3/1981 | Tanaka et al. | 252/107 |
| 4,485,029 | | 11/1984 | Kato et al. | 252/106 |
| 4,500,441 | | 2/1985 | Tanaka et al. | 252/89.1 |
| 4,504,405 | | 3/1985 | Howes | 252/106 |
| 4,614,549 | | 9/1986 | Ogunbiyi et al. | 134/19 |
| 4,731,192 | | 3/1988 | Kenjo et al. | 252/95 |
| 4,734,222 | | 3/1988 | Winterton | 252/546 |
| 4,758,595 | | 7/1988 | Ogunbiyi et al. | 514/635 |
| 4,836,886 | * | 6/1989 | Ogunbiyi et al. | 422/28 |
| 4,836,986 | | 6/1989 | Ogunbiyi et al. | 422/28 |
| 5,096,607 | | 3/1992 | Mowrey-Mckee | 252/106 |
| 5,125,982 | * | 6/1992 | Kazumi et al. | 134/26 |
| 5,370,744 | | 12/1994 | Chowhan | 134/42 |
| 5,505,953 | | 4/1996 | Chowhan | 424/427 |
| 5,532,224 | * | 7/1996 | Desai et al. | 514/63 |
| 5,648,074 | * | 7/1997 | Park et al. | 424/94.2 |
| 5,872,086 | * | 2/1999 | Ellis et al. | 510/112 |

FOREIGN PATENT DOCUMENTS

| | | | |
|---|---|---|---|
| 0279401 | | 8/1988 | (EP) . |
| 0462460 | | 7/1991 | (EP) . |
| 0482525 | * | 4/1992 | (EP) . |
| 2-97913 | | 5/1988 | (JP) . |
| 7900963 | | 11/1979 | (WO) . |
| 88/08309 | | 3/1988 | (WO) . |

* cited by examiner

*Primary Examiner*—Necholus Ogden
(74) *Attorney, Agent, or Firm*—Robert B. Furr, Jr.

(57) ABSTRACT

A cleaning solution for contact lenses is described that includes a carbohydrate that is a mono- or disaccharide, its alcohols or partially hydrolyzed esters or mixtures thereof. Preferred carbohydrates are sorbitol, glucose, maltose, sucrose, dulcitol, dextran, dextrin, mannitol, maltitol, or mannose, preferably in an amount of 0.001 to 10% by weight of an aqueous solution for cleaning the contact lenses. A preferred composition for cleaning contact lenses comprises sorbitol in an amount of about 0.1 to 1% by weight in an aqueous solution. A method for cleaning contact lenses with said carbohydrate cleaning solution is described and may be combined, for simultaneously cleaning and disinfecting contact lenses, with a chemical, antimicrobial agent or thermal disinfecting regimen.

2 Claims, No Drawings

CARBOHYDRATE COMPOSITION AND METHOD FOR CLEANING AND DISINFECTING CONTACT LENSES

This is a continuation of application Ser. No. 08/471,672 filed on Jun. 6, 1995, now abandoned which is a continuation of application Ser. No. 08/175,097 filed on Dec. 29, 1993 now abandoned.

BACKGROUND OF THE INVENTION

1. Field of the Invention

The field of this invention is cleaning contact lenses using carbohydrate compositions. More particularly, the invention relates to compositions and methods that combine cleaning using certain carbohydrates with thermal or chemical disinfecting of contact lenses.

2. Description of the Art

In the normal course of wearing contact lenses, tear film and debris consisting of proteinaceous, oily, sebaceous and related organic manner have a tendency to deposit and build up on lens surfaces. As part of a routine care regimen, contact lenses must be cleaned to remove these film deposits and debris. Without proper cleaning and removal of deposits, wettability and optical quality of the lenses are reduced causing discomfort for the wearer and reduced visual clarity, respectively.

Further, contact lenses, especially those made from hydrophilic materials, must be frequently disinfected to kill harmful microorganisms that collect or grow on lens surfaces. A number of methods for disinfecting contact lenses have been used, such as subjecting the lenses to high temperature, oxidative chemicals or various antimicrobial agents.

Conventionally, the cleaning of contact lenses is accomplished by one or both of two general classes of cleaners, based on surfactants or enzymes. Surfactant cleaners are effective for the removal of some carbohydrate and lipid derived matter and are typically recommended for daily use. However, these cleaners are only slightly effective in the removal of proteinaceous matter, such as lysozyme, a principal component of tears. Typically, proteolytic enzymes, derived from plant, animal or microbial sources, are used to remove proteinaceous deposits. These enzyme cleaners are typically recommended for cleaning lenses once per week at ambient temperatures. As evident from the following description, the present invention is directed to a composition that is not an enzyme cleaner, but rather a composition that can remove protein without the use of an enzyme.

The process of cleaning and disinfecting contact lenses conventionally requires two or more steps. Cleaning typically requires soaking in a cleaning solution of surfactant or enzyme at ambient temperature for a sufficient period to effectively remove deposits. Disinfection involves contacting the lenses with a solution containing antimicrobial agents at ambient temperatures or exposing the lenses in an aqueous solution to elevated temperatures for a time sufficient to achieve disinfection.

Those developing contact lens care products seek to simplify lens care regimens used by lens wearers. As indicated above, a lens care regimen will typically include a number of steps in combination that must be followed to effectively clean and disinfect. It is commonly known that lens wearers often fail to follow complex cleaning and disinfecting methods. Since many of the chemicals utilized in the process, as well as contaminating microorganisms, are harmful to the eye, compliance is an important concern. It is also a goal that the cleaned and disinfected lens, at the end of a one-step regimen, reside in a substantially isotonic solution of such a character that the lens may be inserted directly into the eye without further rubbing and rinsing to remove potentially harmful materials. Ideally, contact lens cleaning/disinfecting regimens would be reduced to a single step. However, combining cleaning and disinfecting in a single step has proved to be difficult to achieve because of competing reactions involved and the nature of the chemicals conventionally used.

Cleaning of proteinaceous deposits from contact lenses has evolved primarily into the use of enzymes that effectively remove this type of contaminant that binds to lens surfaces. Since enzymes may not be safely placed in the eye at the end of the lens cleaning step, they must be removed or deactivated prior to wearing. Since enzymatic cleaners do not substantially disinfect contact lenses, there must be a disinfection step in the regimen. As described above, the disinfection step may be chemical in nature or employ elevated temperature.

At the completion of chemical disinfection, it is generally necessary to either neutralize or rinse residual chemicals from the lens surfaces before they may be safely inserted in the eye. For example, in Huth et al, U.S. Re 32,672, contact lenses are simultaneously cleaned and disinfected by placing them in a solution containing an enzyme and hydrogen peroxide. At completion of the cleaning/disinfecting cycle, residual hydrogen peroxide must be decomposed or neutralized before the lenses can be placed on the eye. A rub and rinse step with an isotonic buffered saline solution is often recommended after neutralization as a final step before insertion of the cleaned and disinfected lenses into the eye.

In U.S. Pat. No. 5,096,607, contact lenses are simultaneously cleaned and disinfected by contacting the lenses with an aqueous system containing a disinfecting amount of an antimicrobial agent, such as a polymeric quaternary ammonium salt or biguanide, and an effective amount of a proteolytic enzyme. The osmotic value of this system is adjusted such that the activity of the antimicrobial agent is not inhibited. While the lenses do not need a separate chemical neutralizing step, they must be rinsed with a suitable isotonic aqueous solution prior to insertion in the eye to remove any residual enzyme therefrom.

Another commonly accepted technique for disinfecting contact lenses after cleaning employs a thermal disinfection process in which the lenses are placed in a solution and elevated in temperature for a period of time sufficient to effect the disinfection. In Ogunbiyi et al, U.S. Pat. No. 4,614,549, cleaning and disinfection are accomplished simultaneously by placing the lenses in a solution comprising a proteolytic enzyme dissolved in water at about room temperature and then heating the solution and lenses to an elevated temperature of about 60–100° C. for about 60 minutes or less. The temperature increase first activates the enzyme to accomplish the cleaning. As the process proceeds, the enzyme is deactivated and removed protein denatured to form a suspended particulate precipitate. The lenses must be rubbed and rinsed prior to insertion in the eye to remove any precipitated protein therefrom. The thermal disinfection technique, of course, requires a special electrical disinfecting apparatus.

There is a continuing need for new cleaning and disinfecting compositions and methods that permit simple cleaning regimens. The formulation of one-step cleaning and disinfecting systems that would allow one to place the cleaned and disinfected lens directly in the eye without prior rinsing or rubbing is always a principal goal.

SUMMARY OF THE INVENTION

It has now surprisingly been found that certain carbohydrate cleaning solutions that are safe for use in the human eye are effective for cleaning proteinaceous deposits from contact lenses. Preferred carbohydrates are certain mono or disaccharides, or an alcohol or a partially hydrolyzed ester of such saccharides or mixtures thereof. Such preferred carbohydrates include, but are not limited to, sorbitol, glucose, maltose, sucrose, dulcitol, dextran, dextrin, mannitol, maltitol, mannose or mixtures thereof in an aqueous solution in an effective amount.

An effective amount of said carbohydrates of the invention is about 0.001 to about 10 weight percent in an aqueous solution. The solution may include buffer compounds such as borate or phosphate buffers to regulate pH. A preferred composition for cleaning comprises sorbitol in an amount of about 0.1% to about 1% by weight in an aqueous solution.

The invention also comprises a method for simultaneously cleaning and disinfecting contact lenses comprising contacting said lenses with a composition comprising a carbohydrate that is a mono or disaccharide, or an alcohol or a partially hydrolyzed ester of such saccharide or mixtures thereof. Preferably, said carbohydrate comprises sorbitol, glucose, maltose, sucrose, dulcitol, dextran, dextrin, mannitol, maltitol or mannose, wherein the composition comprises about 0.001 to about 10 weight percent of said carbohydrate, and said lenses are contacted for a sufficient time to effectively clean said lenses. After cleaning is complete, the solution containing the lenses is then preferably elevated to a temperature of at least about 60° C., for a time sufficient to complete cleaning and disinfecting of lenses.

In an alternative embodiment of the method for simultaneously cleaning and disinfecting contact lenses, the lenses are contacted with a solution containing above-noted carbohydrate and a disinfecting amount of an antimicrobial agent, for a time sufficient to clean and disinfect the lenses.

DETAILED DESCRIPTION OF THE INVENTION

The present invention can be used with all contact lenses, such as hard, soft, rigid gas-permeable and silicone lenses, and is particularly advantageous for cleaning and disinfecting soft lenses such as those commonly referred to as hydrogel lenses. The hydrogel lenses are typically prepared from monomers such as hydroxyethylmethacrylate, vinylpyrrolidone, glycerol methacrylate, methacrylic acid or acid esters and the like. Hydrogel lenses absorb significant amounts of water, such as about 4 to 80% by weight, and bind significantly higher amounts of contaminating proteins than other types of lenses.

The compositions employed herein for cleaning contact lenses contain one (or more) of a carbohydrate that is a mono- or disaccharide, or a sugar alcohol or a partially hydrolyzed ester of such saccharide or mixtures thereof. Preferred carbohydrates are sorbitol, glucose, maltose, sucrose, dulcitol, dextran, dextrin, mannitol, maltitol or mannose. The most preferred composition comprises sorbitol.

The present invention employs the selected carbohydrate or mixtures thereof in an effective amount to clean the lenses. An effective amount is that required to remove, in a reasonable time, a substantial portion of the proteinaceous deposits that occur during normal wear of contact lenses. The carbohydrates of the invention will be effective in an amount of about 0.001 to about 10%. A preferred amount is about 1.0 weight percent of the aqueous cleaning solution. The precise amount of the carbohydrate required to efficaciously clean contact lenses will depend upon a number of factors, including the carbohydrate selected, the amount of proteinaceous deposit on the lenses, the desired soaking period, the specific type of materials comprising the lenses, other cleaning solution and disinfecting components and the like. In general, as appreciated by those skilled in the art, the carbohydrate concentrations useful herein will be adjusted to achieve a desired time for removing the protainaceous contaminants.

The compositions of the present invention may contain additional components that do not adversely affect, to any significant extent, the activity of the selected carbohydrate cleaner. Illustrative examples of such components typically found in ophthalmic solutions include one or more suitable antimicrobial agents, buffering agents, chelating and/or sequestering agents, a tonicity adjusting agent and surfactants.

The carbohydrate composition may contain a preserving or disinfecting amount of one or more antimicrobial agents that are compatible with and do not adversely affect the activity of the carbohydrate or other components. Suitable chemical antimicrobial agents, as the term is used herein, include quaternary ammonium salts and polymers used in ophthalmic applications such as poly [(dimethyliminio)-2-butene-1,4-diyl chlorides], [4-tris(2-hydroxyethyl) ammonio]-2-butenyl-w-[tris(2-hydroxyethyl) ammonio] dichloride, generally available as Polyquaternium 1® from Onyx Corporation, benzylkonium halides, trialkylammonium halides, biguanides such as hexamethylene biguanides and their polymers, oxidizing agents and the like. Preferably, the disinfecting antimicrobial agent is one which alone or in combination will reduce the microbial burden by about one log order in one hour and, more preferably, by about two log orders in four hours. Typically, such agents are present in concentrations ranging from about 0.00001% to about 0.5% (w/v) and more preferably from about 0.00003% to about 0.05% (w/v).

Alternatively, the disinfecting process of the invention is accomplished by thermal means conventionally employing a suitable thermal disinfecting apparatus such as taught by Ogunbiyi et al in U.S. Pat. No. 4,614,549, which is incorporated herein by reference.

The compositions of the present invention can be prepared in various physical forms, such as liquids, solids, emulsions or colloidal suspensions. For example, the carbohydrates and additional ophthalmologic ingredients can be dissolved or suspended in a suitable solvent such as water, glycerol, propylene glycol or the like so long as such carriers and ingredients are compatible with direct insertion into the eye, where such is the intended regimen. Alternatively, the composition can be in the form of a powder or tablet wherein the latter will typically contain binders or other tablet excipients.

The following detailed examples are presented to illustrate the present invention. Both ambient and thermal cleaning processes are performed on the indicated lenses, identified by FDA group characteristics.

EXAMPLE 1

Ten SoftMate® B lenses manufactured by Sola/Barnes-Hind of bufilcon A polymer having a 45% water content (FDA Group III), are soaked for 1 hour in lysozyme at 37° C. in order to deposit protein on the lens, simulating lens wear. Each lens is then placed in a test cleaning solution in a thermal disinfection unit (TDU) and a TDU disinfection cycle completed. The lysozyme soak and TDU disinfecting/cleaning cycle are repeated for seven cycles. Following the last cycle, each lens is soaked in 10 ml of borate buffered saline solution for one hour followed by analysis for total protein utilizing the Ninhydrin procedure, described by G. Minno, L. Eckel, S. Groemminger, B. Minno and T. Wrzosek, in "Quantitative Analysis of Protein Deposits on Hydrophilic Contact Lenses", Optometry and Vision Science, Vol. 68, No.1, pp. 865–872.

The test solutions are each prepared with borate buffered saline solution at pH 7.0–7.2 and osmolality of 290–310 mOsm/kg water. The borate buffered saline consists of 0.85% boric acid, 0.09% sodium borate and 0.45% sodium chloride. Cleaning results are reported in Table 1.

TABLE 1

Simultaneous Cleaning and Thermal Disinfection of Bufilcon Group 3 Contact Lenses

| Cleaning Compound | Conc. [%] | Residual Protein on Lens [μg/lens] | Increased Removal Over Control [%] |
|---|---|---|---|
| Sorbitol | 1% | 10.69 | 58.4 |
| Glucose | 1% | 18.76 | 27.1 |
| Borate Buffered Saline (Control) | — | 25.72 | — |

EXAMPLE 2

A seven cycle ambient cleaning efficacy test is performed for ten new Vistamarc (FDA Group IV) contact lenses, manufactured by Johnson & Johnson Vision Products Inc. of Etaficon A polymer having a 58% water content. The lenses are soaked for one hour in lysozyme at 37° C. in order to deposit protein on the lenses, simulating lens wear. Each lens is placed in 10 mL of the test cleaning solution and soaked for 4 hours. Any protein remaining on the lens is heat fixed after each cycle. The protein deposition and cleaning regimens are repeated for seven cycles. The buffer system is either borate (same as Example 1) or phosphate based. The phosphate buffered saline consists of 0.30% sodium phosphate, dibasic; 0.03% sodium phosphate, monobasic; and 0.85% sodium chloride. Cleaning efficacy results are reported in Table 2.

TABLE 2

Contact Lens Cleaning Efficacy for Vistamarc (FDA Group IV) Lenses at Ambient Temperature.

TABLE 2

| Cleaning Compound | Residual Protein on Lens (μg) | Increased Removal over Control [%] |
|---|---|---|
| Control (BBS)* | 780 | — |
| 1% Sorbitol in BBS | 721 | 7.6 |
| 1% Dulcitol in BBS | 654 | 16.2 |
| 1% Sorbitol in PBS** | 481 | 38.3 |
| 1% Dulcitol in PBS | 509 | 34.7 |

*BBS = Borate Buffered Saline
**PBS = Phosphate Buffered Saline

The results of Table 2 show that selection of buffer may influence cleaning efficiency, depending upon the carbohydrate cleaner selected.

EXAMPLE 3

The procedure of Example 1 is repeated for a cleaning solution of the invention including 1% by weight of sorbitol in borate buffered saline for cleaning various FDA group lens. All formulations are prepared with borate buffered saline (BBS), at a pH of 7.0–7.3 and osmolality of 280–320 mOsm/kg., as described in Example 1. Cleaning results are report in Table 3.

TABLE 3

Contact Lens Cleaning Efficacy for Various FDA Group Lens

| Test Compound | FDA Lens Group | μg Protein Per Lens | Increased Removal Over Control [%] |
|---|---|---|---|
| 1% Sorbitol in BBS | II | 13 | 32 |
| BBS Control | II | 19 | — |
| 1% Sorbitol in BBS[1] | III | 5 | 54 |
| BBS Control | III | 11 | — |
| 1% Sorbitol in BBS | IV | 682 | 18 |
| BBS Control | IV | 827 | — |
| 1% Sorbitol + 0.025% EDTA[2] in BBS | III | 7 | 36 |
| BBS Control & EDTA | III | 11 | — |

[1]Borate Buffered Saline
[2]Ethylenediaminetetracetic acid, disodium salt

EXAMPLE 4

SoftMate® B contact lenses are soaked in a protein deposition solution containing 0.1% hen/lysozyme for one hour at 37° C. The lenses are removed from the protein solution and are thermally cleaned/disinfected in a buffered isotonic solution containing the indicated test cleaning compounds. After the thermal cycle is complete, the lenses are removed from the test solution. The deposit/cleaning cycles are repeated for a total of 7 cycles. The total protein remaining on the lenses is determined using the Ninhydrin method. Ten lenses are tested for each cleaning solution. The results for borate buffered solutions are reported in Table 4.

TABLE 4

Protein Cleaning Efficacy Evaluation of Some Carbohydrates of the Invention on Group III Lenses

| Cleaning Compound | Residual Protein On Lens [μg/lens] | Increased Removal Over Control [%] |
|---|---|---|
| BBS* Control | 8.4 | — |
| 1% Dextrin | 6.1 | 27 |
| 1% Dextran | 5.5 | 34 |
| 1% Sorbitol | 4.0 | 52 |
| 0.1% Sorbitol | 5.5 | 34 |
| 1% Mannitol | 6.1 | 27 |
| BBS* Control | 12.5 | — |
| 1% Maltose | 7.7 | 38 |
| 1% Mannose | 13.8 | 0 |
| 1% Sucrose | 9.2 | 26 |
| 1% Dulcitol | 6.4 | 49 |

*Borate buffered saline

EXAMPLE 5

The procedure of Example 1 is repeated for FDA Group I lenses. Each lens is contacted with the indicated test solutions and is processed through seven protein deposit and thermal/cleaning cycles. The results are reported in Table 5.

TABLE 5

Protein Cleaning Efficacy Evaluation of Some Common Carbohydrates on Group I Lenses

| Cleaning Compound | Buffer | Residual Protein, μg/lens Test | Residual Protein, μg/lens Control | Increased Removal Over Control [%] |
|---|---|---|---|---|
| 1% Sorbitol | BBS | 0.8 | 3.2 | 75 |
| 1% Mannitol | BBS | 2.9 | 3.3 | 12 |
| 1% Maltitol | BBS | 3.2 | 3.3 | 4 |
| 1% Mannose | BBS | 3.2 | 3.3 | 4 |
| 1% Sucrose | BBS | 2.1 | 2.9 | 28 |
| 1% Dextran | BBS | 2.0 | 3.2 | 38 |
| 1% Dextrin | BBS | 1.5 | 3.2 | 53 |
| 1% Sorbitol | PBS | 0.8 | 3.2 | 75 |
| 1% Manitol | PBS | 3.2 | 3.3 | 4 |
| 1% Maltitol | PBS | 2.7 | 3.3 | 18 |
| 1% Mannose | PBS | 3.1 | 3.3 | 6 |
| 1% Sucrose | PBS | 2.2 | 2.9 | 24 |
| 1% Dextran | PBS | 1.0 | 3.2 | 69 |
| 1% Dextrin | PBS | 1.3 | 3.2 | 59 |

It should be apparent to those skilled in the art that the present invention is not limited by the samples set forth above and that the use of specific compositions can be determined from the specification without departing from the invention as herein disclosed and described. It should be understood that the scope of the present invention includes all modifications and variations that fall within the scope of the attached claims.

What is claimed is:

1. A method for one-step cleaning and disinfecting of a contact lens, including the removal of proteinaceous contaminants, which method consists of:

(a) contacting said contact lens with an aqueous solution comprising:

i) a cleaning component comprising from about 0.001 to about 10 weight percent of a carbohydrate selected from the group consisting of sorbitol, glucose, maltose, sucrose, dulcitol, dextran, dextrin, mannitol, maltitol, mannose, and mixtures thereof, and ii) an effective amount of at least about 0.00001 percent by weight of an antimicrobial agent, and (b) placing said contact lenses directly in the eye after contacting said lens with said aqueous solution.

2. A method for one-step cleaning and disinfecting of a contact lens, including removal of proteinaceous contaminants consisting of:

(a) contacting said contact lens with an aqueous solution comprising:

i) a cleaning component comprising from about 0.001 to about 10 weight percent of a carbohydrate that is a mono- or di-saccharide or an alcohol or partially hydrolyzed ester of such saccharides and mixtures thereof, and ii) an effective amount of at least about 0.00001 percent by weight of an antimicrobial agent, and (b) placing said contact lenses directly in the eye after contacting said lens with said aqueous solution.

* * * * *